US008449331B2

(12) United States Patent
Phillips et al.

(10) Patent No.: US 8,449,331 B2
(45) Date of Patent: May 28, 2013

(54) CAGE AND CONNECTOR COVER FOR A RECEPTACLE ASSEMBLY

(75) Inventors: Michael J. Phillips, Camp Hill, PA (US); Randall Robert Henry, Harrisburg, PA (US); Robert Charles Trea, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 63 days.

(21) Appl. No.: 13/197,644

(22) Filed: Aug. 3, 2011

(65) Prior Publication Data

US 2013/0034992 A1 Feb. 7, 2013

(51) Int. Cl.
*H01R 13/648* (2006.01)

(52) U.S. Cl.
USPC ..... 439/607.21; 361/704

(58) Field of Classification Search
USPC ..... 361/704, 715; 439/59, 76.1, 79, 439/637, 638, 607.2, 607.21, 660
See application file for complete search history.

(56) References Cited

U.S. PATENT DOCUMENTS 6,558,191 B2 * 5/2003 Bright et al. ..... 439/541.5
6,729,905 B1 * 5/2004 Hwang ..... 439/607.21
6,731,519 B1 * 5/2004 Hwang ..... 361/818
6,793,517 B2 * 9/2004 Neer et al. ..... 439/372
6,816,376 B2 11/2004 Bright et al.
6,980,437 B2 12/2005 Bright
7,001,217 B2 2/2006 Bright et al.
7,044,777 B1 * 5/2006 Daly et al. ..... 439/540.1
7,357,673 B2 * 4/2008 Long ..... 439/607.2
7,438,596 B2 10/2008 Phillips
7,452,216 B2 * 11/2008 Murr et al. ..... 439/74
7,539,018 B2 5/2009 Murr et al.
7,625,223 B1 12/2009 Fogg
7,898,808 B2 * 3/2011 Joiner et al. ..... 361/707

* cited by examiner

*Primary Examiner* — Thanh Tam Le

(57) ABSTRACT

A cage is provided for a receptacle assembly that includes a receptacle connector. The cage includes an electrically conductive body comprising an upper wall, a lower wall, and side walls that extend from the upper wall to the lower wall. The body has a front end and an internal compartment. The front end is open to the internal compartment of the body. The internal compartment is configured to hold the receptacle connector therein. The internal compartment is configured to receive a pluggable module therein through the front end. A connector cover is integrally formed with the lower wall of the body. The connector cover extends within the internal compartment of the body. The connector cover includes an interior chamber that is configured to hold the receptacle connector therein such that the cover extends over at least a portion of the receptacle connector.

20 Claims, 4 Drawing Sheets

CAGE AND CONNECTOR COVER FOR A RECEPTACLE ASSEMBLY

BACKGROUND OF THE INVENTION

The subject matter described and/or illustrated herein relates generally to receptacle assemblies, and more particularly to electromagnetic interference (EMI) covers for electrical connector assemblies.

Various types of fiber optic and copper based transceiver assemblies that permit communication between host equipment and external devices are known. These transceiver assemblies typically include a pluggable module that is received within a receptacle assembly, which includes a receptacle connector that pluggably connects to the pluggable module. The pluggable modules are constructed according to various standards for size and compatibility, for example the Quad Small Form-factor Pluggable (QSFP) module standard and the XFP standard.

Receptacle assemblies typically include a metal cage having a port that receives the pluggable module therein. The receptacle connector is held in the cage for connection with the pluggable module as the module is inserted into the cage. The receptacle connector is typically covered by a cover that extends over the receptacle connector for reducing and/or containing electromagnetic interference (EMI) emissions. But, known covers are not without disadvantages. For example, providing a receptacle connector with a known cover may increase the number of components, fabrication steps, and/or assembly steps, which may increase a cost of manufacturing the receptacle assembly.

BRIEF DESCRIPTION OF THE INVENTION

In one embodiment, a cage is provided for a receptacle assembly that includes a receptacle connector. The cage includes an electrically conductive body comprising an upper wall, a lower wall, and side walls that extend from the upper wall to the lower wall. The body has a front end and an internal compartment. The front end is open to the internal compartment of the body. The internal compartment is configured to hold the receptacle connector therein. The internal compartment is configured to receive a pluggable module therein through the front end. A connector cover is integrally formed with the lower wall of the body. The connector cover extends within the internal compartment of the body. The connector cover includes an interior chamber that is configured to hold the receptacle connector therein such that the cover extends over at least a portion of the receptacle connector.

In another embodiment, a receptacle assembly is provided for mating with a pluggable module. The receptacle assembly includes a receptacle connector, and a cage having an electrically conductive body that includes an upper wall, a lower wall, and side walls that extend from the upper wall to the lower wall. The body has a front end and an internal compartment. The front end is open to the internal compartment of the body. The receptacle connector is held within the internal compartment. The internal compartment is configured to receive the pluggable module therein through the front end. The cage includes a connector cover that is integrally formed with the lower wall of the body. The connector cover extends within the internal compartment of the body. The connector cover includes an interior chamber that holds the receptacle connector therein such that the cover extends over at least a portion of the receptacle connector.

In another embodiment, a transceiver assembly includes a pluggable module, and a receptacle assembly having a receptacle connector and a cage. The cage includes an upper wall, a lower wall, and side walls that extend from the upper wall to the lower wall. The body has a front end and an internal compartment. The front end is open to the internal compartment of the body. The receptacle connector is held within the internal compartment. The internal compartment is configured to receive the pluggable module therein through the front end. The cage includes a connector cover that is integrally formed with the lower wall of the body. The connector cover extends within the internal compartment of the body. The connector cover includes an interior chamber that holds the receptacle connector therein such that the cover extends over at least a portion of the receptacle connector.

DETAILED DESCRIPTION OF THE INVENTION

Figure 1:
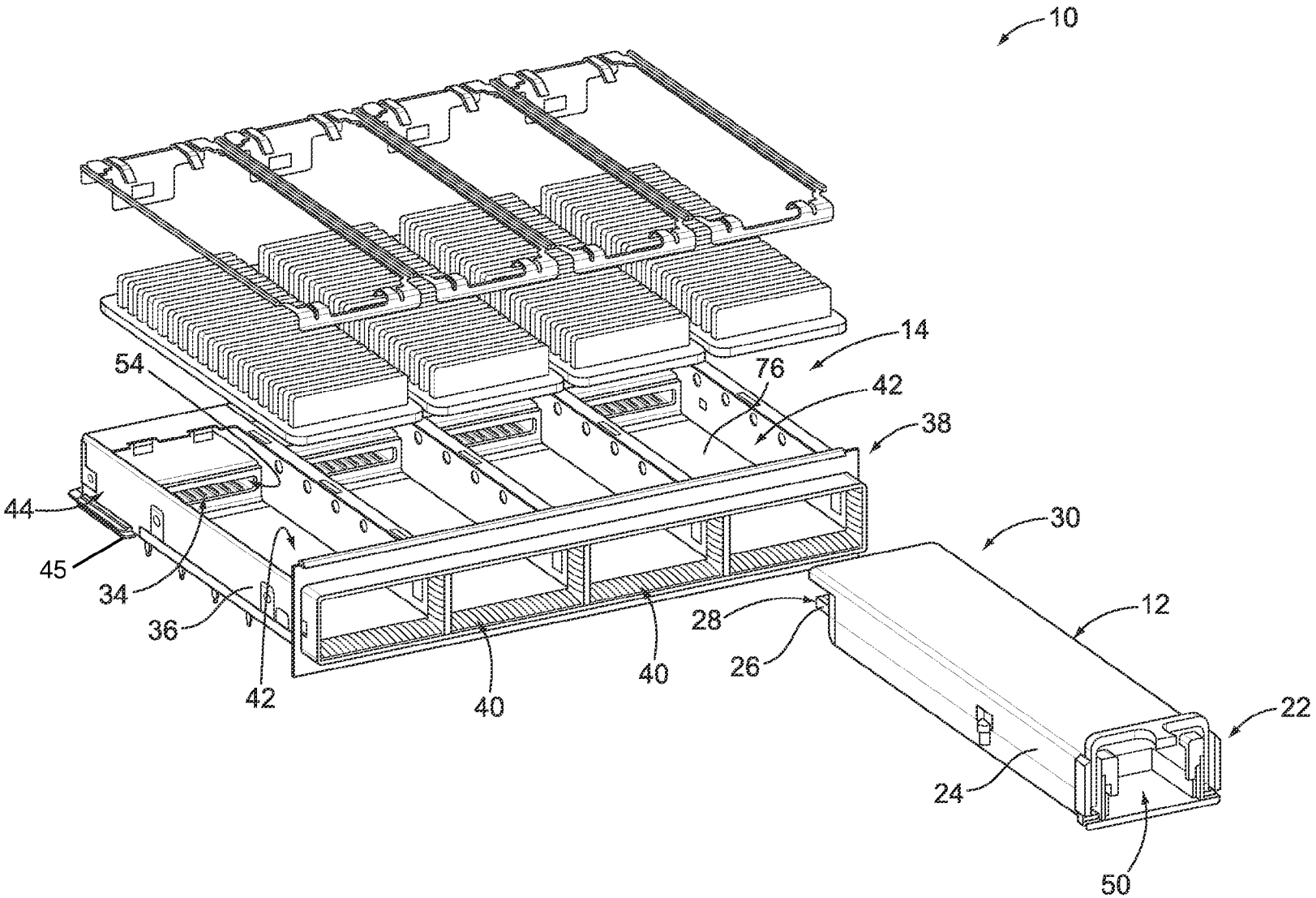
FIG. 1 is an exploded perspective view of an exemplary embodiment of a transceiver assembly.

FIG. 1 is a perspective view of a portion of an exemplary embodiment of a transceiver assembly 10. In the exemplary embodiment, the transceiver assembly 10 is adapted to address, among other things, conveying data signals at high rates, such as data transmission rates of at least 10 gigabits per second (Gbps), which is required by the SFP+ standard. For example, in some embodiments the transceiver assembly 10 is adapted to convey data signals at a data transmission rate of at least 28 Gbps. Moreover, and for example, in some embodiments the transceiver assembly 10 is adapted to convey data signals at a data transmission rate of between approximately 20 Gbps and approximately 30 Gbps. It is appreciated, however, that the benefits and advantages of the subject matter described and/or illustrated herein may accrue equally to other data transmission rates and across a variety of systems and standards. In other words, the subject matter described and/or illustrated herein is not limited to data transmission rates of 10 Gbps or greater, any standard, or the exemplary type of transceiver assembly shown and described herein.

The transceiver assembly 10 includes one or more pluggable modules 12 configured for pluggable insertion into a receptacle assembly 14 that is mounted on a host circuit board (not shown). The host circuit board may be mounted in a host system (not shown) such as, but not limited to, a router, a server, a computer, and/or the like. The host system typically includes a conductive chassis (not shown) having a panel (not shown) including one or more openings (not shown) extending therethrough in substantial alignment with the receptacle assembly 14. The receptacle assembly 14 is optionally electrically connected to the panel. Only one pluggable module 12 is shown in FIG. 1 for clarity.

The pluggable module 12 is configured to be inserted into the receptacle assembly 14. Specifically, the pluggable module 12 is inserted into the receptacle assembly 14 through the panel opening such that a front end 22 of the pluggable module 12 extends outwardly from the receptacle assembly 14. The pluggable module 12 includes a housing 24 that forms a protective shell for a circuit board 26 that is disposed within the housing 24. The circuit board 26 carries circuitry, traces, paths, devices, and/or the like that perform transceiver functions in a known manner. An edge 28 of the circuit board 26 is exposed at a rear end 30 of the housing 24. In an exemplary embodiment, a straddle mount connector 32 (FIG. 2) is mounted to the circuit board 26 and exposed at the rear end 30 of the housing 24 for plugging into a receptacle connector 34 of the receptacle assembly 14. The connector 32 is not shown in FIG. 1. In alternative to the connector 32, the circuit board 26 of the pluggable module 12 may directly mate with the receptacle connector 34. In other words, in some alternative embodiments, the edge 28 of the circuit board 26 of the pluggable module 12 is received within a receptacle 54 of the receptacle connector 34 to electrically connect the pluggable module 12 to the receptacle connector 34.

In general, the pluggable module 12 and the receptacle assembly 14 may be used in any application requiring an interface between a host system and electrical and/or optical signals. The pluggable module 12 interfaces to the host system through the receptacle assembly 14 via a corresponding receptacle connector 34 of the receptacle assembly 14, which is located within an electrically conductive cage 36 (which is sometimes referred to as a "receptacle guide frame" or a "guide frame"). As illustrated in FIG. 1, the cage 36 includes a front end 38 having one or more front openings, or ports, 40 that are open to corresponding internal compartments 42 of the cage 36. The front end 38 of the cage 36 is configured to be mounted, or received, within the opening in the panel. A receptacle connector 34 is positioned within each internal compartment 42 at a rear end 44 of the cage 36. The cage 36 includes one or more openings 140 (FIG. 7) for enabling each receptacle connector 34 to electrically connect to the host circuit board from within the corresponding internal compartment 42. Each internal compartment 42 of the cage 36 is configured to receive the corresponding pluggable module 12 therein in electrical connection with the corresponding receptacle connector 34. The cage 36 optionally includes a flange 45 that provides a surface that enables a gasket (not shown) of the host circuit board to seal to the cage 36.

Each pluggable module 12 interfaces to one or more optical cables (not shown) and/or one or more electrical cables (not shown) through a connector interface 50 at the front end 22 of the module 12. Optionally, the connector interface 50 comprises a mechanism that cooperates with a fiber or cable assembly (not shown) to secure the fiber or cable assembly to the pluggable module 12. Suitable connector interfaces 50 are known and include adapters for the LC style fiber connectors and the MTP/MPO style fiber connectors offered by Tyco Electronics Corporation (Harrisburg, Pa.).

Although the cage 36 is shown as including a plurality of internal compartments 42 and a plurality of ports 40 for electrically connecting a plurality of pluggable modules 12 to the host circuit board, the cage 36 may include any number of internal compartments 42 and ports 40, arranged in any pattern, configuration, arrangement, and/or the like (such as, but not limited to, any number of rows and/or columns), for electrically connecting any number of pluggable modules 12 to the host circuit board.

Figure 2:
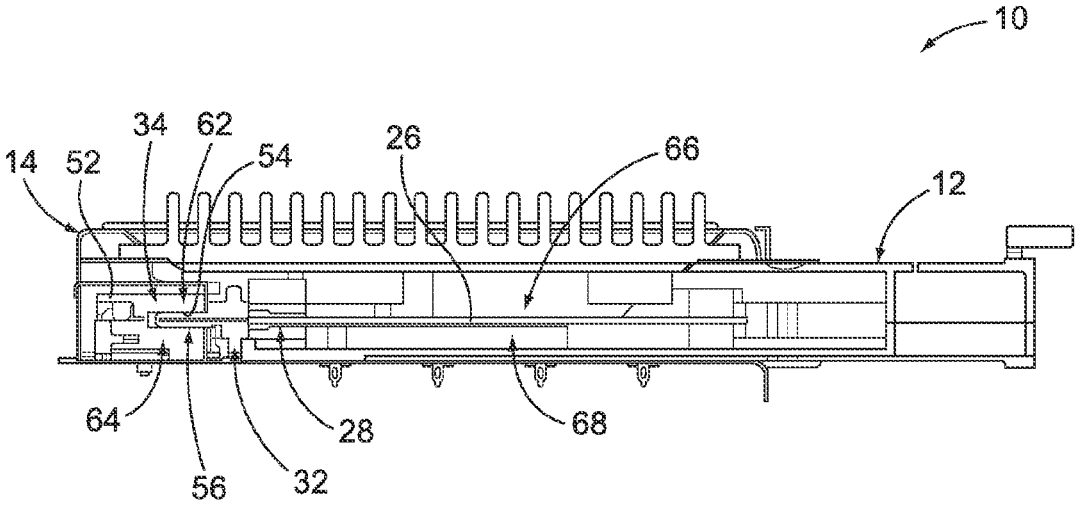
FIG. 2 is a cross-sectional view of the transceiver assembly shown in FIG. 1 illustrating an exemplary embodiment of a pluggable module mated with an exemplary embodiment of a receptacle assembly.

FIG. 2 is a cross-sectional view of the transceiver assembly 10 illustrating a pluggable module 12 received within the receptacle assembly 14 and mated with the corresponding receptacle connector 34. The receptacle connector 34 is mounted on the host circuit board. The receptacle connector 34 includes a dielectric connector body 52 having the receptacle 54. Optionally, the straddle mount connector 32 is mounted to the edge 28 of the circuit board 26 in electrical connection therewith.

The receptacle 54 of the receptacle connector 34 receives a plug 56 of the straddle mount connector 32 therein. The receptacle connector 34 includes electrical contacts (not shown) that extend within the receptacle 54 and engage corresponding electrical contacts (not shown) on opposite sides 62 and 64 of the plug 56 of the straddle mount connector 32. The electrical contacts of the straddle mount connector 32 are electrically connected to corresponding electrically conductive contact pads (not shown) on opposite sides 66 and 68 of the circuit board 26 to establish an electrical connection between the circuit board 26 and the host circuit board.

Figure 3:
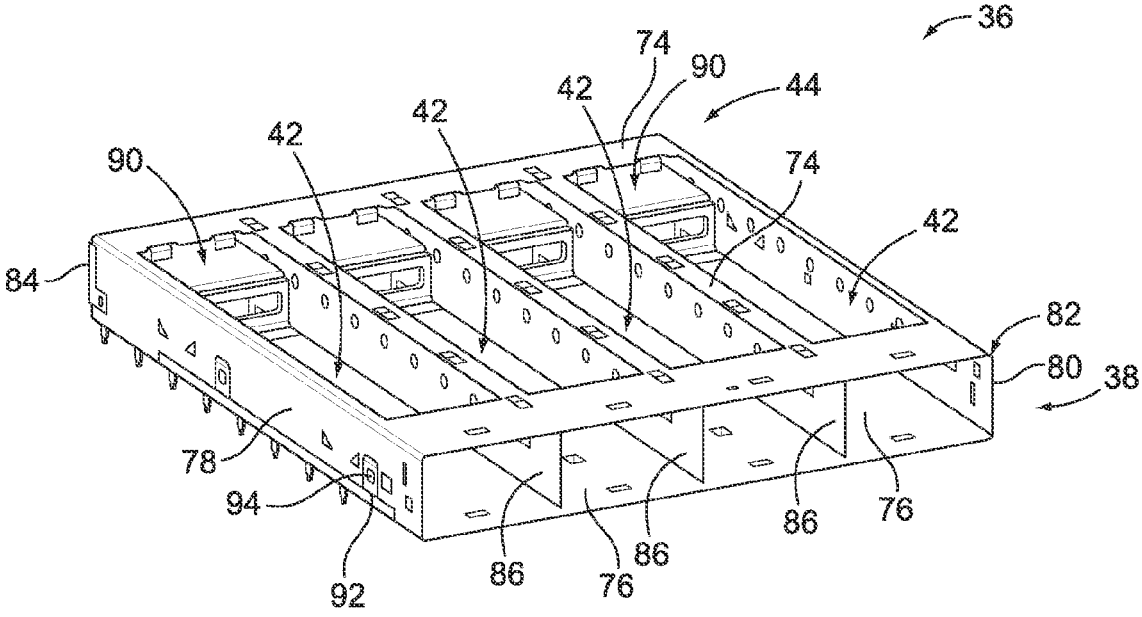
FIG. 3 is a perspective view of a portion of an exemplary embodiment of a cage of the transceiver assembly shown in FIGS. 1 and 2.
Figure 4:
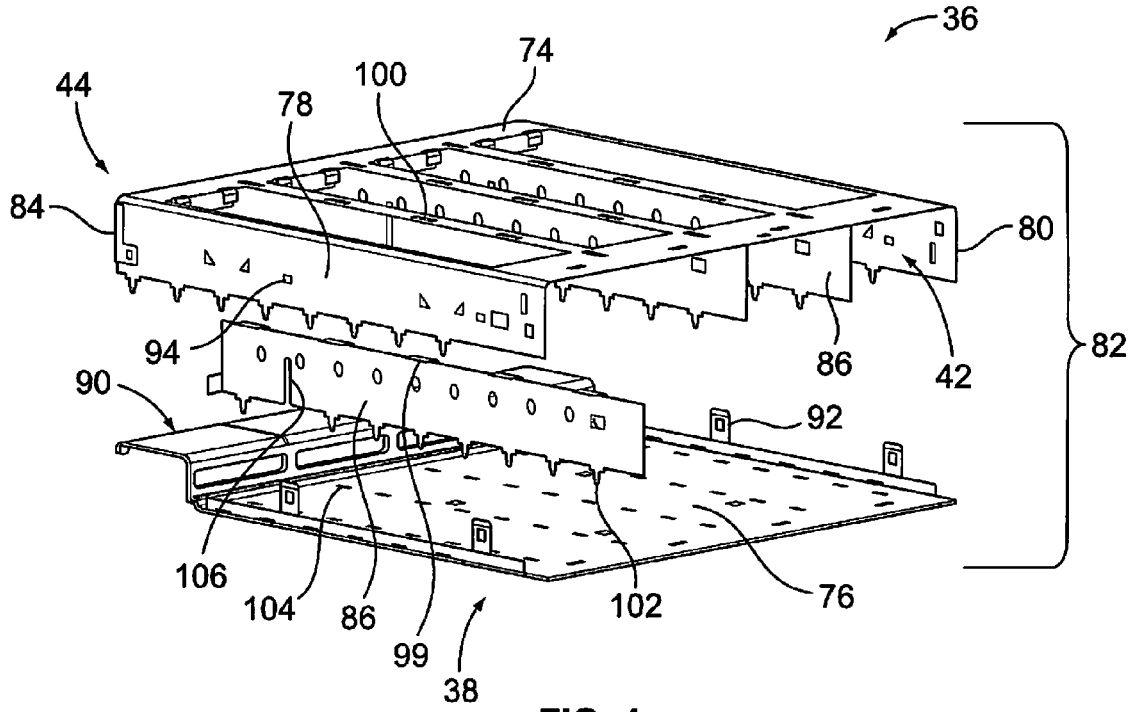
FIG. 4 is an exploded perspective view of the cage shown in FIG. 3.
Figure 5:
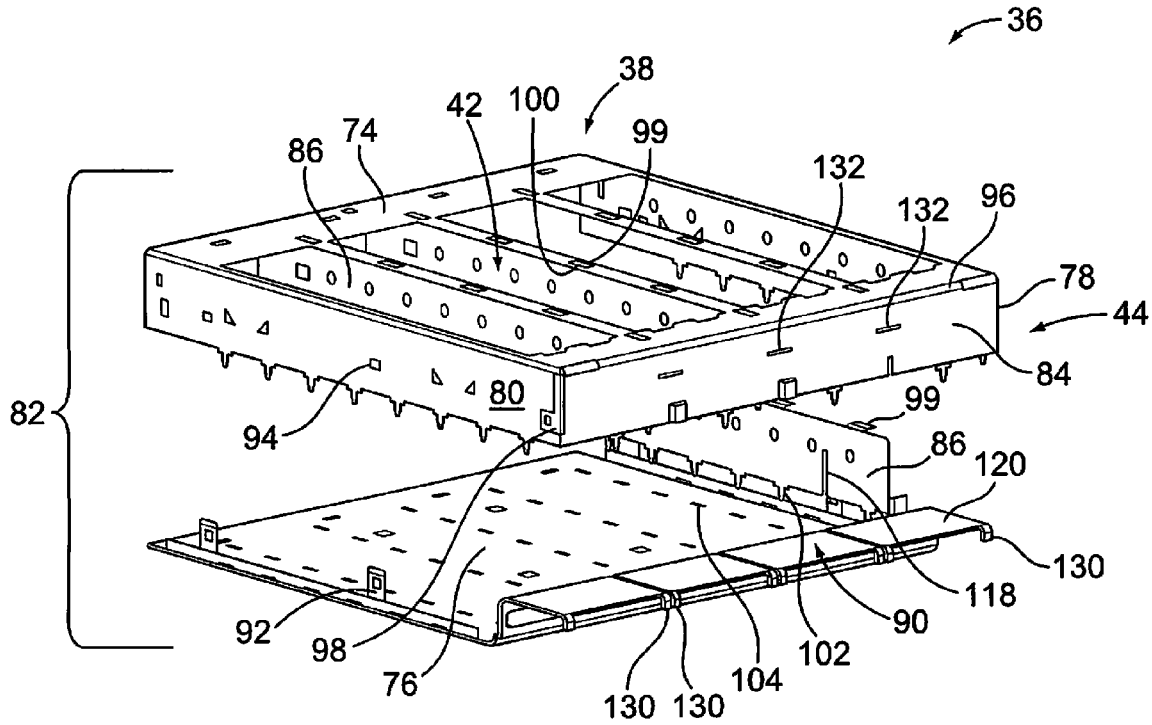
FIG. 5 is another exploded perspective view of the cage viewed from a different angle than FIG. 4.

FIG. 3 is a perspective view of the cage 36. FIG. 4 is an exploded perspective view of the cage 36. FIG. 5 is an exploded perspective view of the cage 36 viewed from a different angle than FIG. 4. The cage 36 includes an electrically conductive body 82. The body 82 of the cage 36 extends a length from the front end 38 to the rear end 44. The cage body 82 includes an upper wall 74, the lower wall 76, and side walls 78 and 80 that extend from the upper wall 74 to the lower wall 76. The body 82 of the cage 36 also includes a rear wall 84 that extends from the upper wall 74 to the lower wall 76 at the rear end 44. Optionally, the cage body 82 includes one or more divider walls 86 that divide the body 82 into the plurality of internal compartments 42. The cage body 82 may include any number of the divider walls 86 for dividing the body 82 into any number of internal compartments 42. In some alternative embodiments, the body 82 of the cage 36 does not include any divider walls 86 such that the body 82 includes only a single internal compartment 42.

In an exemplary embodiment, the cage 36 includes a generally rectangular cross-sectional shape, defined by the walls 74, 76, 78, and 80, such that the cage 36 generally has the shape of a parallelepiped. But, the cage 36 may include any other shape.

The body 82 of the cage 36 includes a cover 90 that is integrally formed with the lower wall 76 of the cage body 82. As will be described below, the cover 90 is configured to extend over at least a portion of the receptacle connector 34 (FIGS. 1, 2, and 7) to facilitate reducing and/or containing electromagnetic interference (EMI) emissions. In the exemplary embodiment, the cover 90 is a single cover 90 that extends within each of the internal compartments 42. Alternatively, the cage 36 may include a plurality of covers 90, wherein each cover 90 extends within one or more corresponding internal compartments 42. The cover 90 may be referred to herein as a "connector cover".

As used herein, two or more items are "integrally formed" when the items are formed as a single continuous structure. In contrast, two or more items are not "integrally-formed" if the items are formed as two or more discrete structures. One example of items that are formed as a continuous structure is two items that formed from the same stamp of a sheet of material. In some embodiments, two or more items are considered to be formed as a single continuous structure if the items are incapable of being separated without damaging (such as, but not limited to, cutting through) at least one of the items. Optionally, two or more items are "formed as a single continuous structure" whether or not the two or more items are formed from the same materials and/or are formed simultaneously. In some embodiments, two or more items are considered to be formed as discrete structures if the items are engaged with each other after formation of both of the items and/or if the items are mechanically joined together after formation of both of the items using a mechanical fastener (e.g., an adhesive, a clip, a clamp, a weld, a solder joint, a threaded fastener, a non-threaded fastener, and/or the like). Optionally, two or more items are "formed as discrete structures" whether or not the two or more items are formed from the same materials and/or are formed simultaneously.

In an exemplary embodiment, the side walls 78 and 80 of the cage body 82 are integrally formed with the upper wall 74, while the lower wall 76 is a discrete component (of the cage body 82) relative to the upper wall 74 and the side walls 78 and 80. The lower wall 76 is mechanically connected to the side walls 78 and 80 using any suitable connection structure, means, type, and/or the like that enables a mechanical connection between the lower wall 76 and the side walls 78 and 80. In an exemplary embodiment, the lower wall 76 includes one or more mounting clips 92 that engage one or more corresponding mounting tabs 94 on the side walls 78 and 80 with a snap-fit connection to mechanically connect the lower wall 76 to the side walls 78 and 80. In addition or alternatively to being integrally formed with the upper wall 74, the side walls 78 and/or 80 may be integrally formed with the lower wall 76.

Referring now solely to FIG. 5, the rear wall 84 of the cage body 82 is a discrete component (of the cage body 82) relative to the upper wall 74, the side walls 78 and 80, and the lower wall 76. The rear wall 84 is mechanically connected to the upper wall 74 and the side walls 78 and 80 using any suitable connection structure, means, type, and/or the like that enables a mechanical connection, such as, but not limited to, one or more mounting lips 96 and/or one or more mounting clips 98. As will be described below, the rear wall 84 is also mechanically connected to the lower wall 76 via the cover 90. In some alternative embodiments, the rear wall 84 is integrally formed with the upper wall 74, the side walls 78 and/or 80, and/or the lower wall 76.

Referring now to FIGS. 4 and 5, the divider walls 86 of the cage body 82 are discrete components (of the cage body 82) relative to the upper wall 74 and the lower wall 76. Each divider wall 86 is mechanically connected to the upper wall 74 and the lower wall 76 using any suitable connection structure, means, type, and/or the like that enables a mechanical connection. In an exemplary embodiment, the divider walls 86 are mechanically connected to the upper wall 74 via one or more mounting tabs 99 that are received within one or more corresponding slots 100 that extend within the upper wall 74. The divider walls 86 are mechanically connected to the lower wall 76 through one or more tines 102 that extend through one or more corresponding slots 104 within the lower wall 76. The tines 102 are optionally received within corresponding vias (not shown) of the host circuit board to electrically connect the cage body 82 to the hose circuit board. In some alternative embodiments, one or more of the divider walls 86 is integrally formed with the upper wall 74 and/or the lower wall 76. The divider walls 86 include optional slots 106 that receive a front segment 118 (FIGS. 6 and 7) of the cover 90 therein, as will be described below.

Figure 6:
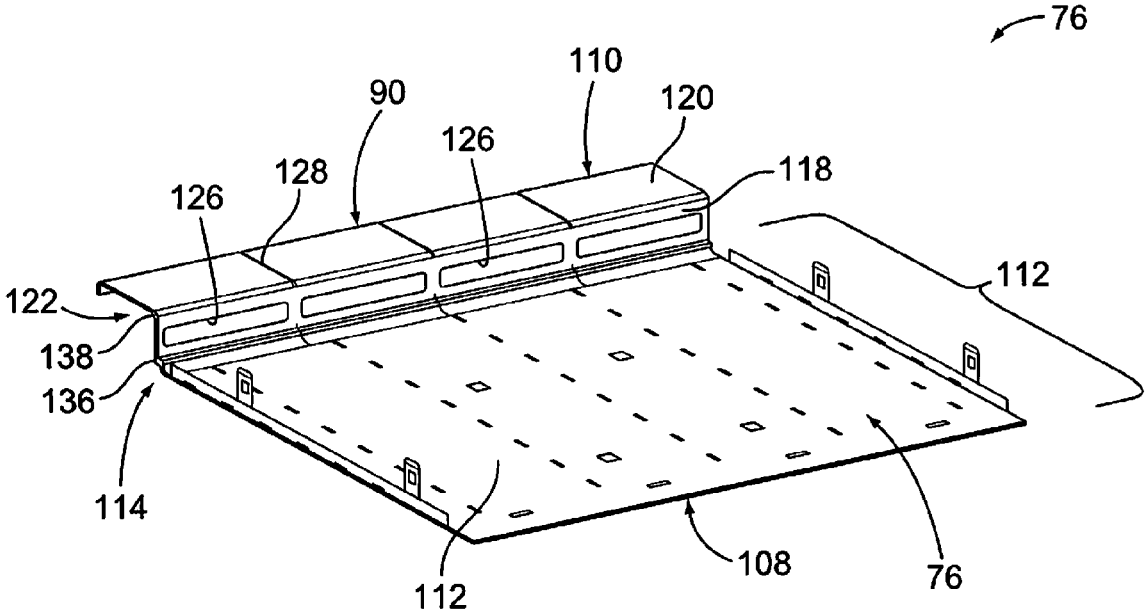
FIG. 6 is a perspective view of an exemplary embodiment of a lower wall of the cage shown in FIGS. 3-5.
Figure 7:
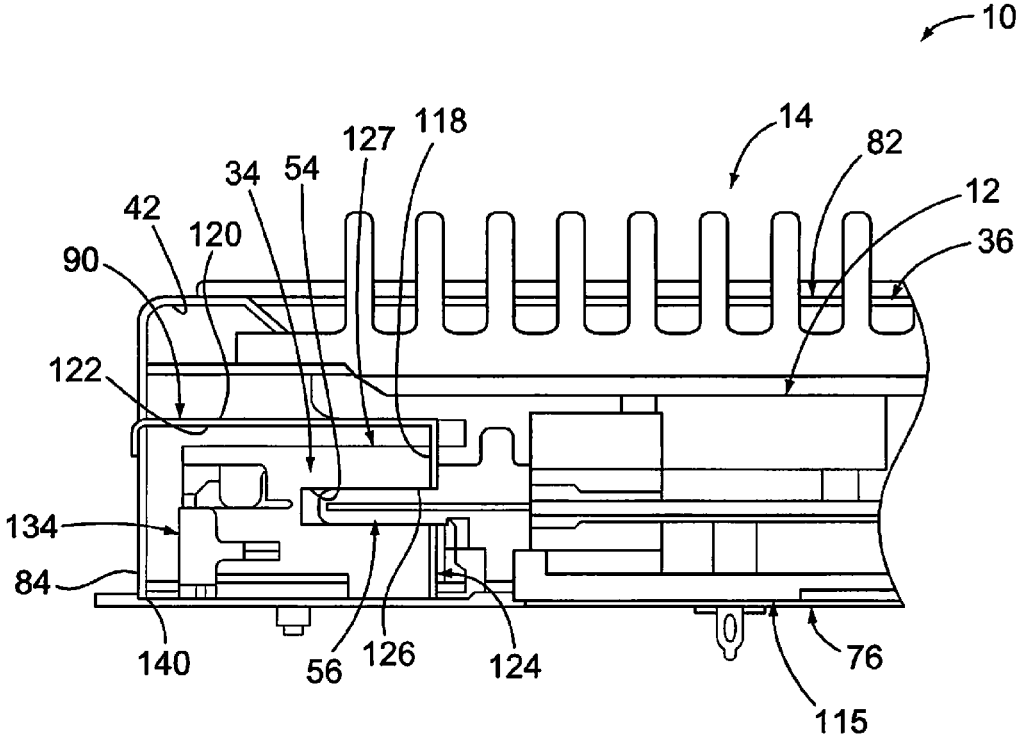
FIG. 7 is an enlarged cross-sectional view of a portion the transceiver assembly shown in FIGS. 1 and 2.

FIG. 6 is a perspective view of the lower wall 76 of the cage body 82. The lower wall 76 extends a length from a front edge 108 to a rear edge 110. The lower wall 76 includes a module segment 112 that includes the front edge 108. The front edge 108 forms a portion of the front end 38 (FIGS. 1 and 3-5) of the cage body 82. The module segment 112 extends a length from the front edge 108 to a rear end 114 of the module segment 112. The module segment 112 extends over a lower side 115 (FIG. 7) of the pluggable module 12 (FIGS. 1, 2, and 7) when the pluggable module 12 is received within the receptacle assembly 14 (FIGS. 1, 2, and 7).

The cover 90 extends from the rear end 114 of the module segment 112 of the lower wall 76. The cover 90 includes a front segment 118, an upper segment 120, and an interior chamber 122 defined between the segments 118 and 120. The interior chamber 122 is configured to hold the receptacle connectors 34 therein. In embodiments wherein the cage 36 includes a plurality of covers 90, each cover 90 includes an interior chamber 122 that holds one or more corresponding receptacle connectors 34 therein.

The front segment 118 extends from the rear end 114 of the module segment 112 of the lower wall 76. The front segment 118 extends from the module segment 112 of the lower wall 76 at any non-parallel angle relative to the length of the module segment 112. In an exemplary embodiment, the front segment 118 extends from the module segment 112 at an approximately perpendicular angle relative to the length of the module segment 112. The front segment 118 is configured to extend over at least a portion of a front side 124 (FIG. 7) of the receptacle connector 34 (FIGS. 1, 2, and 7), as will be described below. The front segment 118 includes one or more ports 126 positioned along the front segment 118 to enable the pluggable module 12 to mate with the receptacle connector 34 through the cover 90. In embodiments wherein the cage 36 includes a plurality of covers 90, each cover 90 includes a port 126 that receives one or more corresponding pluggable modules 12 therethrough. Optionally, an electromagnetic interference (EMI) gasket (not shown) extends circumferentially about one or more of the ports 126

The upper segment 120 extends from the front segment 118 at any non-parallel angle relative to the front segment 118. In an exemplary embodiment, the upper segment 120 extends from the front segment 118 at an approximately perpendicular angle. The upper segment 120 extends from the front segment 118 to the rear edge 110 of the lower wall 76. In other words, the upper segment 120 includes the rear edge 110 of the lower wall 76. As will be described below, the upper segment 120 is configured to extend over at least a portion of an upper side 127 (FIG. 7) of the receptacle connector 34. The upper segment 120 includes optional slots 128 that receive corresponding divider wall 86 therein. In embodiments wherein the cage 36 includes a plurality of covers 90, adjacent covers 90 may be spaced apart from each other instead of having the slots 128.

Referring again to FIG. 5, the cover 90 is optionally configured to be mechanically and/or electrically connected to the rear wall 84 of the cage body 82. In an exemplary embodiment, the upper segment 120 of the cover 90 includes one or more connection tabs 130 that extend through one or more corresponding slots 132 of the rear wall 84 to establish the mechanical and/or electrical connection between the cover 90 and the rear wall 84. Any other suitable connection means, structure, type, and/or the like may additionally or alternatively be used to mechanically and/or electrically connect the cover 90 to the rear wall 84. In some embodiments, the cover 90 includes a rear segment (not shown) that extends from the upper segment 120 (at any non-parallel angle relative to the upper segment 120) for extending over at least a portion of a rear side 134 (FIG. 7) of the receptacle connector 34 (FIGS. 1, 2, and 7).

Referring again to FIG. 6, and as described above, the cover 90 is integrally formed with the lower wall 76. More specifically, the cover 90 is integrally formed with the module segment 112 of the lower wall 76. In an exemplary embodiment, the cover 90 is fabricated by bending the lower wall 76 to distinguish the cover 90 from the module segment 112 of the lower wall 76. In other words, the cover 90 is fabricated by bending the lower wall 76 to define a "bent segment" of the lower wall 76. The bent segment (i.e., the cover 90) of the lower wall 76 is defined by the segments 118 and 120, which are sub-segments of the bent segment. The cover 90 is fabricated in an exemplary embodiment by bending the bent segment of the lower wall 76 up and over the locations within the internal compartments 42 (FIGS. 1, 3-5, and 7) that are configured to hold the receptacle connectors 34. In some alternative embodiments, the cover 90 is fabricated by another method in addition or alternatively to bending the lower wall 76, such as, but not limited to, casting the lower wall 76 (with or without other walls of the cage 36) and/or the like.

The cover 90 includes at least two bends 136 and 138. The front segment 118 of the cover 90 extends from the module segment 112 of the lower wall 76 at the bend 136, while the upper segment 120 extends from the front segment 118 at the bend 138. In embodiments wherein the cover 90 includes a rear segment that extends over a portion of the rear side 134 (FIG. 7) of the receptacle connector 34 (FIGS. 1, 2, and 7), the cover 90 may include another bend (not shown) at the interface between the upper segment 120 and the rear segment. Each of the bends 136 and 138 may have any suitable non-parallel angle, such as, but not limited to, approximately 90°. The bend between the upper segment 120 and a rear segment of the cover 90 may have any suitable non-parallel angle, such as, but not limited to, approximately 90°.

FIG. 7 is an enlarged cross-sectional view of a portion of the transceiver assembly 10 illustrating the cover 90 extending over one of the receptacle connectors 34. When a pluggable module 12 is received within the receptacle assembly 14, the module segment 112 of the lower wall 76 of the cage 36 extends over the lower side 115 of the pluggable module 12. The plug 56 of the pluggable module 12 extends through the corresponding port 126 of the cover 90 and into the receptacle 54 of the corresponding receptacle connector 34 such that the pluggable module 12 is electrically connected to the receptacle connector 34.

The cover 90 extends within the internal compartments 42 of the cage body 82. In embodiments wherein the cage 36 includes a plurality of covers 90, each cover 90 extends within one or more corresponding internal compartments 42. The receptacle connector 34 shown in FIG. 7 is received within the interior chamber 122 of the cover 90 such that the cover 90 extends over at least a portion of the receptacle connector 34. For example, the front segment 118 of the cover extends over at least a portion of the front side 124 of the receptacle connector 34, and the upper segment 120 extends over at least a portion of the upper side 127 of the receptacle connector 34. The segments 118 and 120 may each extend over any amount of the respective sides 124 and 127.

In an exemplary embodiment, the rear wall 84 of the cage body 82 extends over at least a portion of the rear side 134 of the receptacle connector 34. The rear wall 84 may extend over any amount of the rear side 134. As described above, in some embodiments, the cover 90 includes a rear segment (not shown) that extends over at least a portion of the rear side 134 of the receptacle connector 34. Although not visible in FIG. 7, it should be apparent that the side wall 78, the side wall 80, and the divider walls 86 extend over at least portions of sides (not shown) of the receptacle connectors 34 that extend between the upper side 127 and the front side 124.

By extending over the receptacle connector 34, the cover 90 is configured to facilitate reducing and/or containing electromagnetic interference (EMI) emissions emitted from and/or received by the receptacle connector 34.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cage for a receptacle assembly that includes a receptacle connector, the cage comprising:

an electrically conductive body comprising an upper wall, a lower wall, and side walls that extend from the upper wall to the lower wall; the body having a front end and an internal compartment, the front end being open to the internal compartment of the body, the internal compartment being configured to hold the receptacle connector therein, the internal compartment being configured to receive a pluggable module therein through the front end; and a connector cover integrally formed with the lower wall of the body, the connector cover extending within the internal compartment of the body, the connector cover comprising an interior chamber that is configured to hold the receptacle connector therein such that the cover extends over at least a portion of the receptacle connector.

2. The cage of claim 1, wherein the connector cover comprises a bent segment of the lower wall, the connector cover being fabricated by bending the lower wall to define the bent segment.

3. The cage of claim 1, wherein the connector cover comprises a bent segment of the lower wall, the bent segment comprising at least two bends, the connector cover being fabricated by bending the bent segment up and over a location within the internal compartment that is configured to hold the receptacle connector.

4. The cage of claim 1, wherein the connector cover comprises a front segment and an upper segment that extends from the front segment at a non-parallel angle relative to the front segment, the front segment extending from a module segment of the lower wall at a non-parallel angle relative to the module segment, the front segment being configured to extend over at least a portion of a front side of the receptacle connector, the upper segment being configured to extend over at least a portion of an upper side of the receptacle connector.

5. The cage of claim 1, wherein the lower wall is a discrete component of the body of the cage relative to the upper wall and relative to the side walls, the lower wall being mechanically connected to the side walls.

6. The cage of claim 1, wherein the lower wall comprises an opening that enables the receptacle connector to be mounted to an electrical component through the lower wall.

7. The cage of claim 1, wherein the body extends a length from the front end to a rear end, the connector cover extending within the internal compartment of the body at the rear end of the body.

8. The cage of claim 1, wherein the connector cover comprises a port positioned to enable the pluggable module to mate with the receptacle connector through the connector cover.

9. The cage of claim 1, wherein the cage comprises a rear wall, the connector cover being at least one of mechanically or electrically connected to the rear wall.

10. A receptacle assembly for mating with a pluggable module, the receptacle assembly comprising:

a receptacle connector; and a cage comprising an electrically conductive body having an upper wall, a lower wall, and side walls that extend from the upper wall to the lower wall, the body having a front end and an internal compartment, the front end being open to the internal compartment of the body, the receptacle connector being held within the internal compartment, the internal compartment being configured to receive the pluggable module therein through the front end, the cage comprising a connector cover that is integrally formed with the lower wall of the body, the connector cover extending within the internal compartment of the body, the connector cover comprising an interior chamber that holds the receptacle connector therein such that the cover extends over at least a portion of the receptacle connector.

11. The assembly of claim 10, wherein the connector cover comprises a bent segment of the lower wall, the bent segment comprising at least two bends, the connector cover being fabricated by bending the bent segment up and over a location within the internal compartment wherein the receptacle connector is held.

12. The assembly of claim 10, wherein the connector cover comprises a front segment and an upper segment that extends from the front segment at a non-parallel angle relative to the front segment, the front segment extending from a module segment of the lower wall at a non-parallel angle relative to the module segment, the front segment extending over at least a portion of a front side of the receptacle connector, the upper segment extending over at least a portion of an upper side of the receptacle connector.

13. The assembly of claim 10, wherein the lower wall is a discrete component of the body of the cage relative to the upper wall and relative to the side walls, the lower wall being mechanically connected to the side walls.

14. The assembly of claim 10, wherein the lower wall comprises an opening that enables the receptacle connector to be mounted to an electrical component through the lower wall.

15. The assembly of claim 10, wherein the connector cover comprises a port positioned to enable the pluggable module to mate with the receptacle connector through the connector cover.

16. A transceiver assembly comprising:

a pluggable module; and a receptacle assembly comprising:

a receptacle connector; and a cage comprising an electrically conductive body having an upper wall, a lower wall, and side walls that extend from the upper wall to the lower wall, the body having a front end and an internal compartment, the front end being open to the internal compartment of the body, the receptacle connector being held within the internal compartment, the internal compartment being configured to receive the pluggable module therein through the front end, the cage comprising a connector cover that is integrally formed with the lower wall of the body, the connector cover extending within the internal compartment of the body, the connector cover comprising an interior chamber that holds the receptacle connector therein such that the cover extends over at least a portion of the receptacle connector.

17. The assembly of claim 16, wherein the connector cover comprises a bent segment of the lower wall, the bent segment comprising at least two bends, the connector cover being fabricated by bending the bent segment up and over a location within the internal compartment wherein the receptacle connector is held.

18. The assembly of claim 16, wherein the connector cover comprises a front segment and an upper segment that extends from the front segment at a non-parallel angle relative to the front segment, the front segment extending from a module segment of the lower wall at a non-parallel angle relative to the module segment, the front segment extending over at least a portion of a front side of the receptacle connector, the upper segment extending over at least a portion of an upper side of the receptacle connector.

19. The assembly of claim 16, wherein the lower wall is a discrete component of the body of the cage relative to the upper wall and relative to the side walls, the lower wall being mechanically connected to the side walls.

20. The assembly of claim 16, wherein the lower wall comprises an opening that enables the receptacle connector to be mounted to an electrical component through the lower wall.

* * * * *